US008292571B2

(12) United States Patent
Ballard, Jr. et al.

(10) Patent No.: US 8,292,571 B2
(45) Date of Patent: Oct. 23, 2012

(54) APPARATUS AND METHOD FOR CLEARANCE CONTROL OF TURBINE BLADE TIP

(75) Inventors: Henry Grady Ballard, Jr., Easley, SC (US); Bradley James Miller, Simpsonville, SC (US); Kenneth Damon Black, Travelers Rest, SC (US)

(73) Assignee: General Electric Company, Schenectady, NY (US)

( * ) Notice: Subject to any disclaimer, the term of this patent is extended or adjusted under 35 U.S.C. 154(b) by 1663 days.

(21) Appl. No.: 11/871,430

(22) Filed: Oct. 12, 2007

(65) Prior Publication Data

US 2009/0097968 A1 Apr. 16, 2009

(51) Int. Cl.
*F04D 29/40* (2006.01)

(52) U.S. Cl. ..... 415/126; 415/136; 415/173.2

(58) Field of Classification Search ..... 415/126, 415/127, 136, 134, 139, 173.2, 174.1
See application file for complete search history.

(56) References Cited

U.S. PATENT DOCUMENTS 5,228,828 A * 7/1993 Damlis et al. ..... 415/173.2
2007/0003411 A1 1/2007 Manzoori

* cited by examiner

*Primary Examiner* — Dwayne J White
(74) *Attorney, Agent, or Firm* — Cantor Colburn LLP

(57) ABSTRACT

An inner shell for a rotating machine including at least one segment; and at least one complementary segment in operable communication with the at least one segment, the segments forming a support structure for a shroud ring; wherein the at least one segment and the at least one complementary segment are individually moved to change a set of dimensions defined by the at least one segment and the at least one complementary segment. A method for controlling a dimension of the shroud ring in a rotating machine is also disclosed.

23 Claims, 8 Drawing Sheets

FIG. 3A
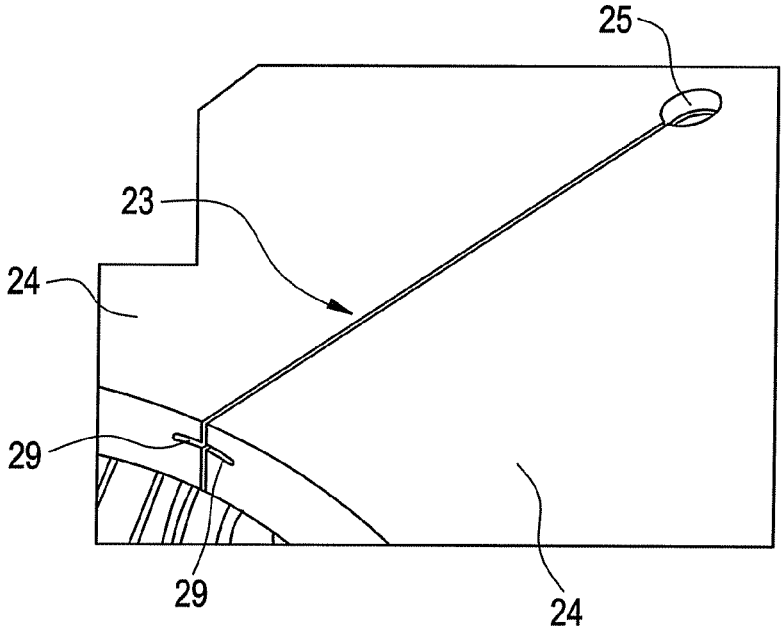
FIG. 3C
FIG. 3B
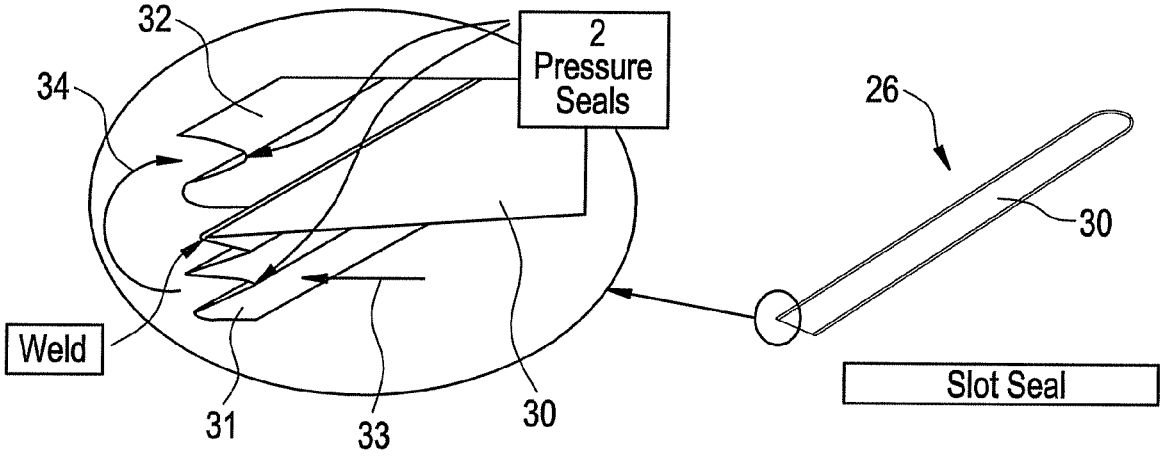

APPARATUS AND METHOD FOR CLEARANCE CONTROL OF TURBINE BLADE TIP

BACKGROUND OF THE INVENTION

1. Field of the Invention

The invention disclosed herein relates to the field of gas turbines. In particular, the invention is used to provide control of turbine blade tip clearance.

2. Description of the Related Art

A gas turbine includes many parts, each of which may expand or contract as operational conditions change. A turbine interacts with hot gases emitted from a combustion chamber to turn a shaft. The shaft is generally coupled to a compressor and, in some embodiments, a device for receiving energy such as an electric generator. The turbine is generally adjacent to the combustion chamber. The turbine uses blades, sometimes referred to as "buckets," for using energy of the hot gases to turn the shaft.

The turbine blades rotate within a shroud ring. As the hot gases impinge on the turbine blades, the shaft is turned. The shroud ring is used to prevent the hot gases from escaping around the turbine blades and, therefore, not turning the shaft.

The distance between the end of one turbine blade and the shroud ring is referred to as "clearance." As the clearance increases, efficiency of the turbine decreases as hot gases escape through the clearance. Therefore, an amount of clearance can affect the overall efficiency of the gas turbine.

If the amount of clearance is too small, then thermal properties of the turbine blades, the shroud ring, and other components can cause the turbine blades to rub the shroud ring. When the turbine blades rub the shroud ring, damage to the turbine blades, the shroud ring and the turbine may occur. It is important, therefore, to maintain a minimal clearance during a variety of operational conditions.

Therefore, what are needed are techniques to reduce clearance between turbine blades and a shroud ring in a gas turbine. The techniques should be useful for a variety of operational conditions.

BRIEF DESCRIPTION OF THE INVENTION

Disclosed is one embodiment of an inner shell for a rotating machine including at least one segment; and at least one complementary segment in operable communication with the at least one segment, the segments forming a support structure for a shroud ring; wherein the at least one segment and the at least one complementary segment are individually moved to change a set of dimensions defined by the at least one segment and the at least one complementary segment.

Also disclosed is one embodiment of a rotating machine including a housing; a rotating component disposed at the housing; a shroud ring disposed adjacent to the rotating component; a shell comprising segments, at least one segment in operable communication with the shroud ring, wherein at least one dimension of the shroud ring is adjustable by the shell.

Further disclosed is one example of a method for controlling a dimension of a shroud ring in a rotating machine, the method including receiving information from a control system; moving one or more segments of a segmented shell using the information, the shell in operable communication with the shroud ring; and deforming the shroud ring with the one or more segments.

BRIEF DESCRIPTION OF THE DRAWINGS

The subject matter which is regarded as the invention is particularly pointed out and distinctly claimed in the claims at the conclusion of the specification. The foregoing and other features and advantages of the invention are apparent from the following detailed description taken in conjunction with the accompanying drawings, wherein like elements are numbered alike, in which:

FIGS. 3A, 3B, and 3C, collectively referred to as FIG. 3 illustrate an exemplary embodiment of a slot between adjacent segments and an inter-segment seal;

DETAILED DESCRIPTION OF THE INVENTION

Figure 1:
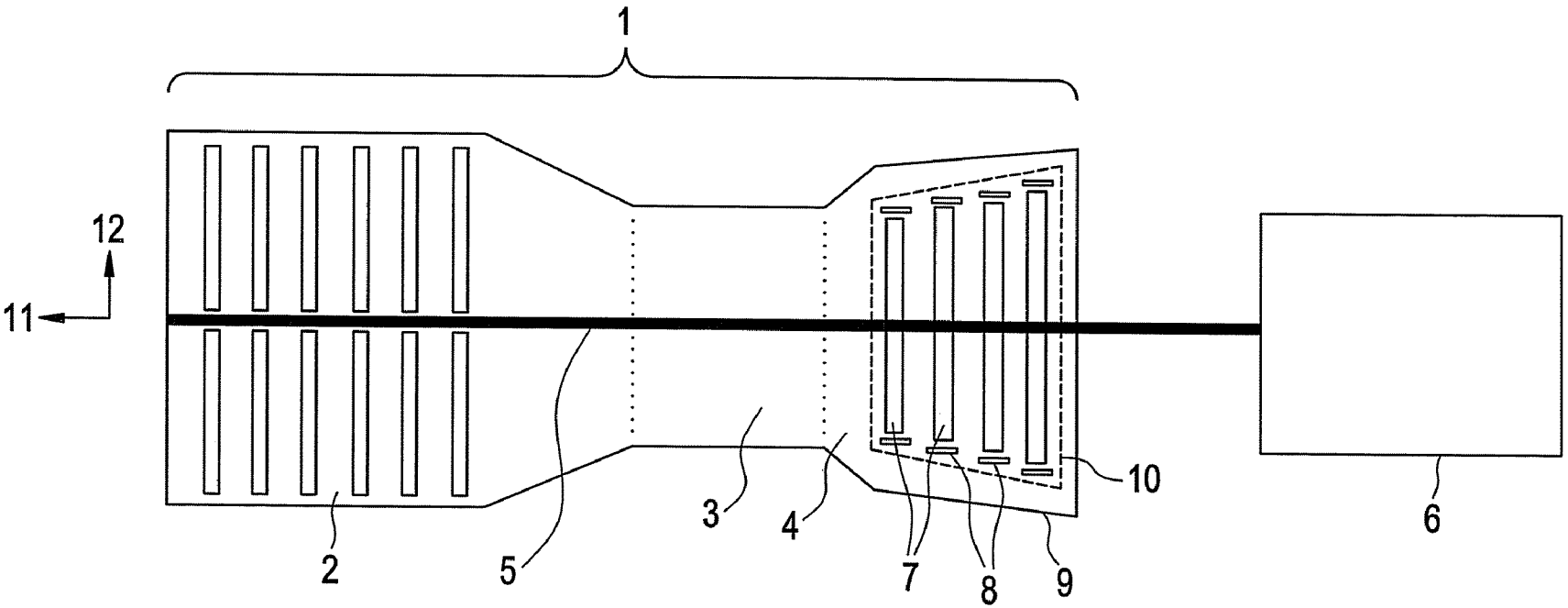
FIG. 1 illustrates an exemplary embodiment of a gas turbine.

Various embodiments of apparatus and methods for controlling a clearance between a plurality of blades and a shroud ring in a rotating machine are disclosed herein. While the illustrated embodiments are devoted to controlling the clearance between a plurality of turbine blades and the shroud ring in a gas turbine, it is to be appreciated that the general teachings herein are applicable to other types of machines such as compressors and pumps.

Specifically taught herein are apparatus and methods for controlling a dimension of the shroud ring, such as the diameter, to maintain a desired amount of clearance between the shroud ring and a set of turbine blades. In one embodiment, the desired amount of clearance is a minimum amount of clearance that avoids rubbing of the blades against the shroud ring.

For convenience, certain definitions are provided. The term "rotating machine" relates to machinery that includes blades disposed circumferentially about a shaft. The shaft and blades rotate together to at least one of compress a gas, pump a fluid, convert a fluid flow to rotational work, and convert a gas flow to rotational work. The term "gas turbine" relates to a rotating machine that is a continuous combustion engine. The gas turbine generally includes a compressor, a combustion chamber and a turbine. The combustion chamber emits hot gases that are directed to the turbine. The term "turbine blade" relates to a blade included in the turbine. Each turbine blade generally has an airfoil shape for converting the hot gases impinging on the bucket into rotational work. The term "turbine stage" relates to a plurality of turbine blades disposed circumferentially about a section of a turbine shaft. The turbine blades of the turbine stage are arranged in a circular pattern about the shaft. The term "shroud ring" relates to a structure for preventing the hot gases from escaping, unimpeded, around the turbine blades of the turbine stage. The structure is disposed radially outward from the turbine stage and may be at least one of cylindrical and conical. In general, there is one shroud ring for each turbine stage. The term "clearance" relates to an amount of distance between a tip of the turbine blade and the shroud ring. The term "inner turbine shell" relates to a structure coupled to the shroud ring. The inner turbine shell surrounds the shroud ring and holds the shroud ring in place. The inner turbine shell may be coupled to several shroud rings as well as nozzles between turbine stages. The term "casing" (or "housing") relates to a structure surrounding the inner turbine shell. The casing provides structural integrity for the entire rotating machine. The casing also provides a pressure boundary between the external pressure and the internal pressure of the gas turbine. The term "circularity" relates to a degree to which a structure is round. For example, a structure with a high degree of circularity has more roundness than a structure with low circularity. The term "perimetrically" relates to a perimeter.

FIG. 1 schematically illustrates an exemplary embodiment of a gas turbine 1. The gas turbine 1 includes a compressor 2, a combustion chamber 3, and a turbine 4. The compressor 2 is coupled to the turbine 4 by a turbine shaft 5. In the non-limiting embodiment of FIG. 1, the turbine shaft 5 is also coupled to an electric generator 6. (In other embodiments, the turbine shaft 5 may be coupled to other types of machinery such as a compressor or pump.) The turbine 4 includes turbine stages 7, respective shroud rings 8, an inner turbine shell 10 and a casing 9. The inner turbine shell 10 surrounds the shroud rings 8. In general, the inner turbine shell 10 has a tapered or conical shape to conform to the sizes of the turbine stages 7. Also depicted in FIG. 1 is a longitudinal axis 11 in line with the shaft 5 and a radial direction 12 representative of radial directions normal to the shaft 5. The turbine 4 is described in more detail next.

Figure 2A:
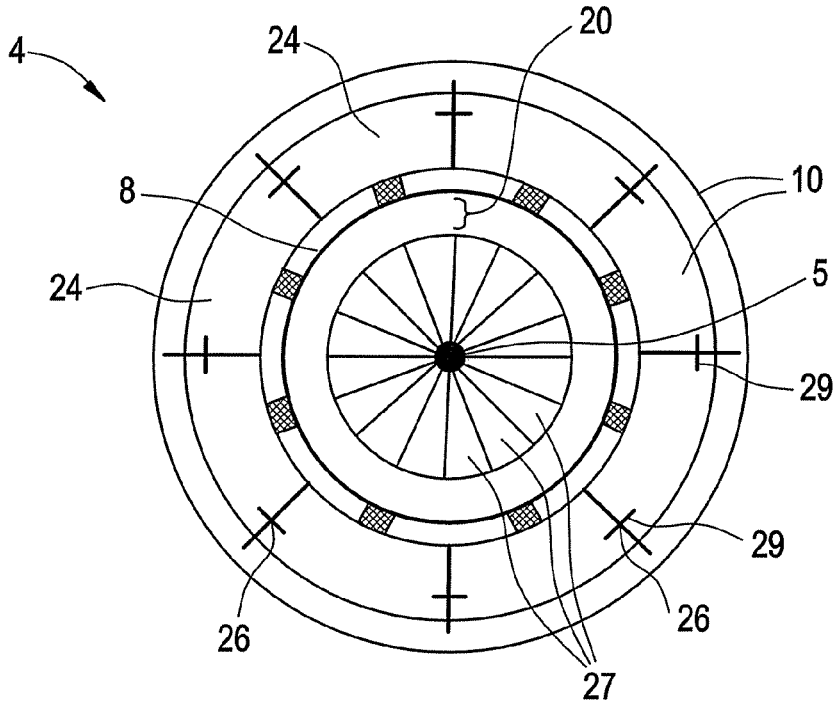
FIGS. 2A and 2B, collectively referred to FIG. 2, illustrate an exemplary embodiment of a turbine stage and an inner turbine shell.

FIG. 2 illustrates an exemplary embodiment of the turbine 4. FIG. 2A illustrates an end view of the turbine 4. Referring to FIG. 2A, a clearance 20 is shown. The shroud ring 8 shown in FIG. 2A encloses a plurality of turbine blades 27 by about 360 degrees. In some embodiments, the shroud ring 8 is built from a plurality of shroud ring segments that include a plurality of arc segments, each arc segment less than 360 degrees. The shroud ring 8 may be made from a material that allows the shroud ring 8 to expand and contract. The arc segments of the shroud ring 8 are affixed to the inner turbine shell 10 such that, as the inner turbine shell 10 expands and contracts, the shroud ring 8 will also expand and contract. The "free" end of the inner turbine shell 10 (affixed to the shroud ring 8) contracts radially in accordance with an amount of force imposed radially upon the free end. By controlling the diameter of the inner turbine shell 10 and, thus, the shroud ring 8, the clearance 20 can be minimized without an increase in a risk of rubbing.

Figure 2B:
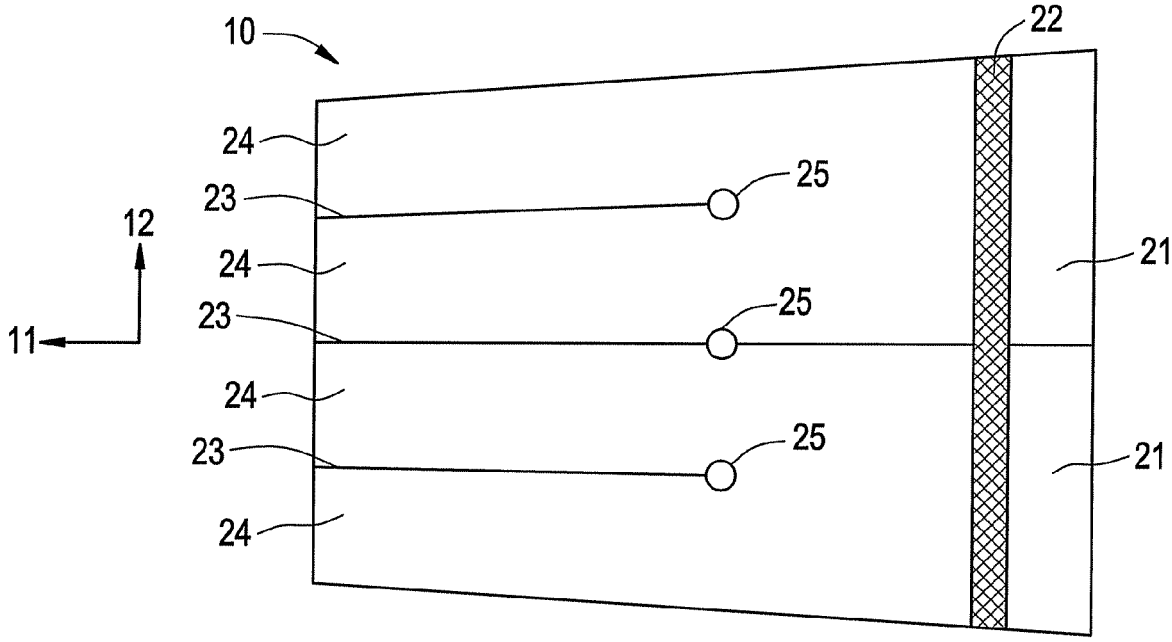

FIG. 2B illustrates a side view of the turbine 4. Referring to FIG. 2B, the inner turbine shell 10 includes an assembly of sections 21. The sections 21 are held together by a hoop 22. The inner turbine shell 10 also includes a plurality of segments 24. Each segment 24 can move substantially in the radial direction 12. By moving in the radial direction 12, each segment 24 can expand or contract the shroud ring 8. A force imposed on one segment in the radial direction 12 will cause part the shroud ring 8 to expand or contract substantially in the radial direction 12. A radial force imposed on all the segments in unison (or collectively) will cause the shroud ring 8 to expand or contract and maintain a degree of roundness. In general, as the number of segments 24 increase, the degree of roundness imposed upon the shroud ring 8 also increases. Each segment 24 is separated from an adjacent segment 24 by a slot 23. The slot 23 affords free displacement between adjacent segments 24 without contact. A hole 25 is provided at one end of the slot 23 to limit stress to the inner turbine shell 10 imposed by moving the segments 24 at least one of radially inward and radially outward, either individually or in unison.

Referring to FIG. 2A, an inter-segment seal referred to as a "slot seal 26" is provided to seal the opening caused by each slot 23 in the inner turbine shell 10. The slot seal 26 is disposed between two adjacent segments 24. FIG. 3A illustrates a three dimensional view of the slot 23 and the hole 25. FIGS. 3B and 3C illustrate a detailed view of an exemplary embodiment of the slot seal 26 that seals the slot 23 depicted in FIG. 3A. The slot seal 26 includes a strip seal 30 welded to an inner pressure seal 31 and an outer pressure seal 32. In general, the inner pressure seal 31 and the outer pressure seal 32 has folds to provide sealing. Because of the folds, an increase in pressure to the seals 31 and 32 results in an increase of sealing effectiveness. The inner pressure seal 31 seals against hot turbine gases 33 in the turbine 4. The outer pressure seal 32 seals against any leakage 34 by the inner pressure seal 31. The slot seal 26 is inserted into a sealing slot 29 in each of the adjacent segments 24 shown in FIG. 2A and FIG. 3A. In the embodiments of FIGS. 2A and 3A, the sealing slot 29 is generally perpendicular to each slot 23. However, the sealing slot 29 may be of any angle and shape necessary to optimize sealing.

Figure 4A:
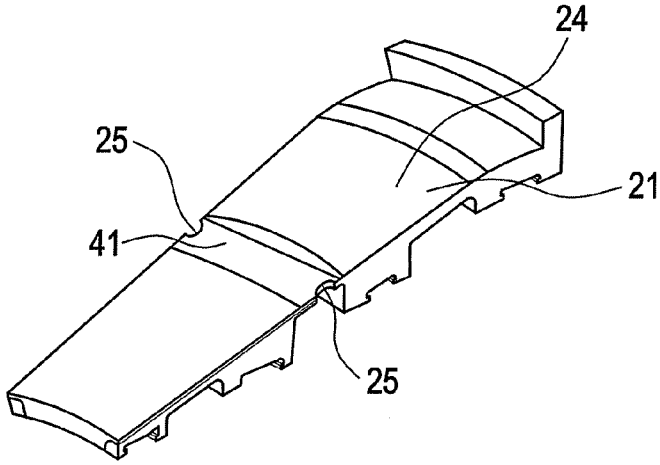
FIGS. 4A and 4B, collectively referred to as FIG. 4, illustrate an exemplary embodiment of a segment of the inner turbine shell.
Figure 4B:
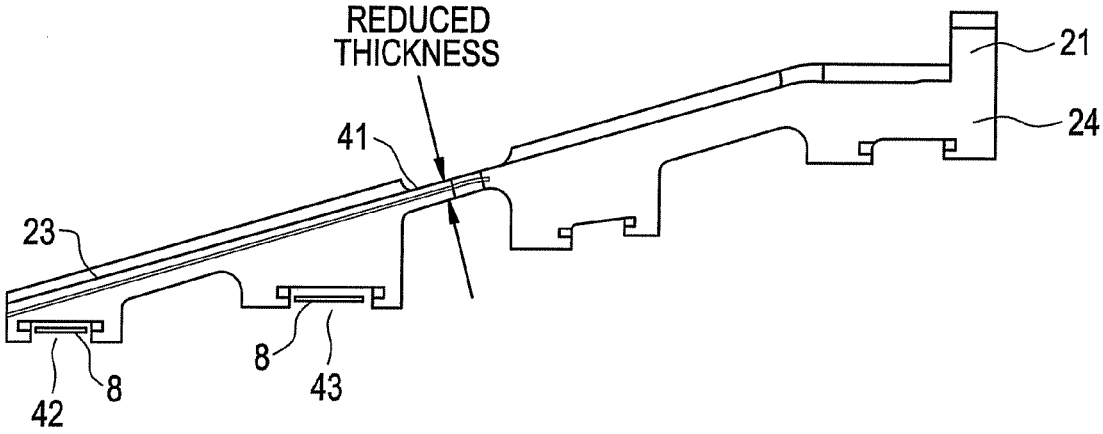

FIG. 4 depicts another exemplary embodiment of one segment 24. In the embodiment of FIG. 4, each segment 24 is also one section 21. Assembling the sections 21 into a circular pattern provides the inner turbine shell 10. Referring to FIG. 4A, each segment 24 has a generally curved shape about the longitudinal axis 11. The segment 24 shown in FIG. 4 has two flat surfaces to form a flat beam 41. The flat beam 41 provides for bending of a portion of the segment 24. The portion that moves is coupled to the shroud rings 8 associated with two turbine stages 7 (depicted at 42 and 43 in FIG. 4B). As depicted in FIG. 4, the flat beam 41 has a reduced thickness to increase flexibility of the free end of the segment 24 affixed to the shroud ring 8.

Figure 5:
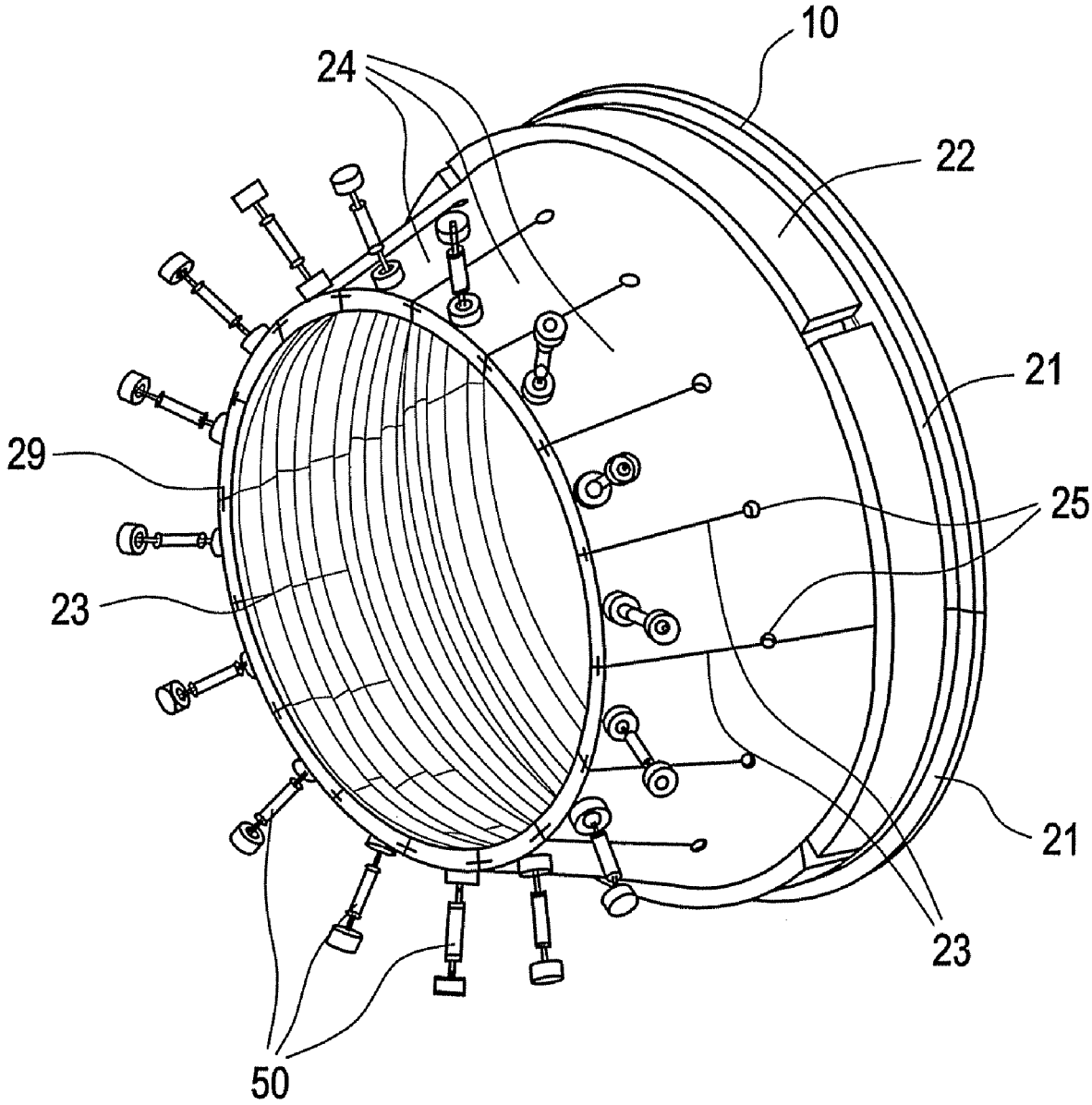
FIG. 5 illustrates an exemplary embodiment of the inner turbine shell with actuators coupled to a plurality segments.

The teachings provide that the segments 24 move in one of unison and individually. In general, when the segments 24 move individually, each segment 24 is coupled to an actuator. FIG. 5 illustrates an exemplary embodiment of the inner turbine shell 10 in which each segment 24 is coupled to an actuator 50. The actuator 50 may be one of an electrical actuator such as a solenoid, an electro-mechanical actuator such as an electrically operated screw, and a mechanical actuator such as a hydraulic piston. The mechanical actuator may be any actuator not including electrical actuation. In one embodiment, the actuator 50 may operate using pressure applied to a piston. In another embodiment, the actuator 50 may operate thermally using the temperature of a gas to cause movement of the actuator 50 as is known to those skilled in the art of actuators. In another embodiment, the actuator 50 may operate chemically. The actuator 50 may move in at least one of along the longitudinal axis 11 and the radial direction 12. When the actuator 50 moves along the longitudinal axis 11, a mechanical device is used to convert motion to the radial direction 12. When the actuator 50 moves along the radial direction 12, no conversion of motion is required. The actuator 50 may be one of a single acting actuator and a double acting actuator. A single-acting actuator 50 provides force in one direction. The single acting actuator 50 relies on a counteracting force provided by the turbine gases 33 or stiffness of the segments 24 to move in the other direction. A double acting actuator 50 provides force in two directions.

Figure 6:
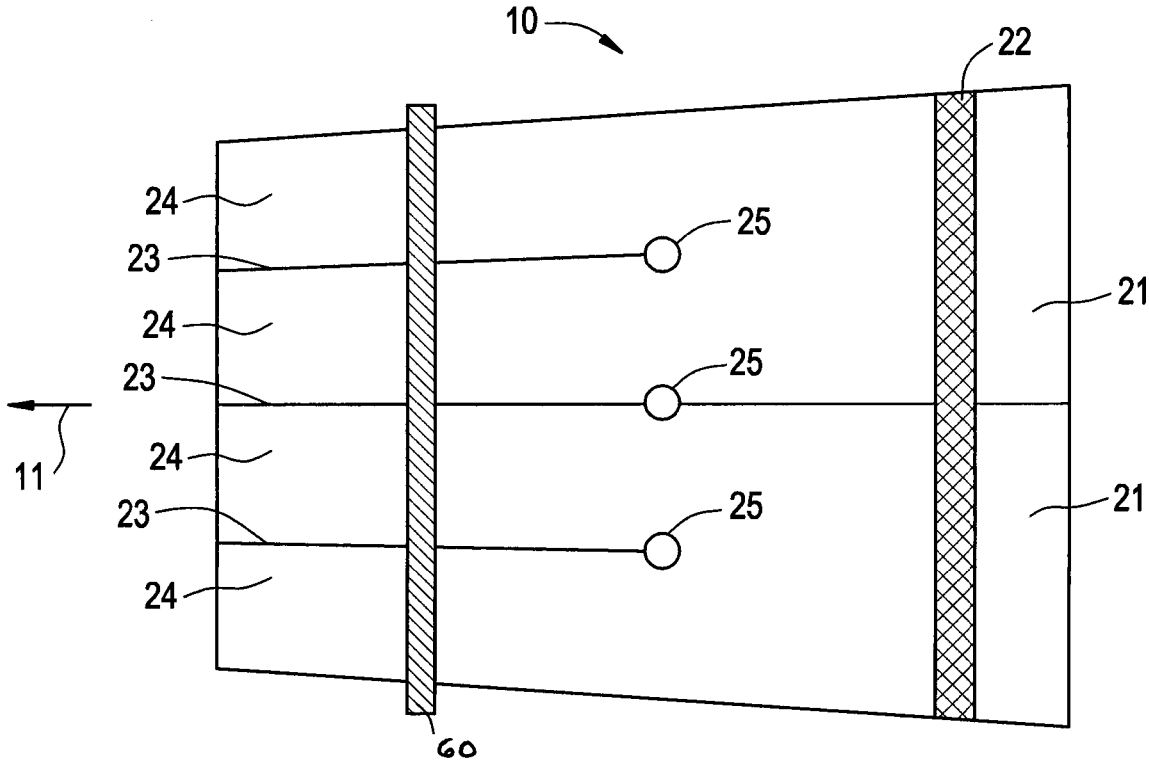
FIG. 6 illustrates an exemplary embodiment of the inner turbine shell with a sleeve.

Moving the segments 24 in unison is used to maintain roundness of the shroud ring 8. When the segments 24 move in unison, at least one actuator 50 is used to move a device that moves the segments 24 in unison. In one embodiment the device is a ring or sleeve surrounding the segments 24 of the inner turbine shell 10. FIG. 6 illustrates a sleeve 60 surrounding the segments 24. By moving the sleeve 60 along one direction of the longitudinal axis 11, the conical shape of the inner turbine shell 10 will force the segments 24 to move in unison and contract the shroud ring 8. By moving the sleeve 60 in the opposite direction, pressure from the turbine gases 33 or stiffness of each segment 24 will cause the segments 24 to move in unison to expand the shroud ring 8. In one embodiment, the sleeve 60 may make contact directly with the segments 24. In another embodiment, the sleeve 60 may use at least one of rollers, cams, linear bearings, and mechanical linkages to make contact with the segments 24. In another embodiment, the sleeve 60 may engage circumferential threads of the inner turbine shell 10. In this embodiment, as the sleeve 60 is rotated, the sleeve moves along the longitudinal axis 11 to one of expand and contract the shroud ring 8. Moreover, longitudinal actuation may also be double acting wherein motion of the ring or the sleeve 60 in either direction forces the shroud ring 8 to expand or contract accordingly.

The segments 24 may also be moved in unison by applying the same pressure of a gas to an outside surface of all the segments 24. When gas pressure is used to move the segments 24, the pressure of the turbine gases 33 or stiffness of each segment 24 is used to move the segments 24 in a direction opposing the gas pressure. Movement of the segments 24 can also be accomplished by using the pressure differential between the exterior and the interior of the inner turbine shell 10. When the exterior pressure of the inner turbine shell 10 is greater than the interior pressure, the net effect is to move the segments 24 radially inward. Conversely, when the exterior pressure of the inner turbine shell 10 is less than the interior pressure, the net effect is to move the segments 24 radially outward.

Figure 7:
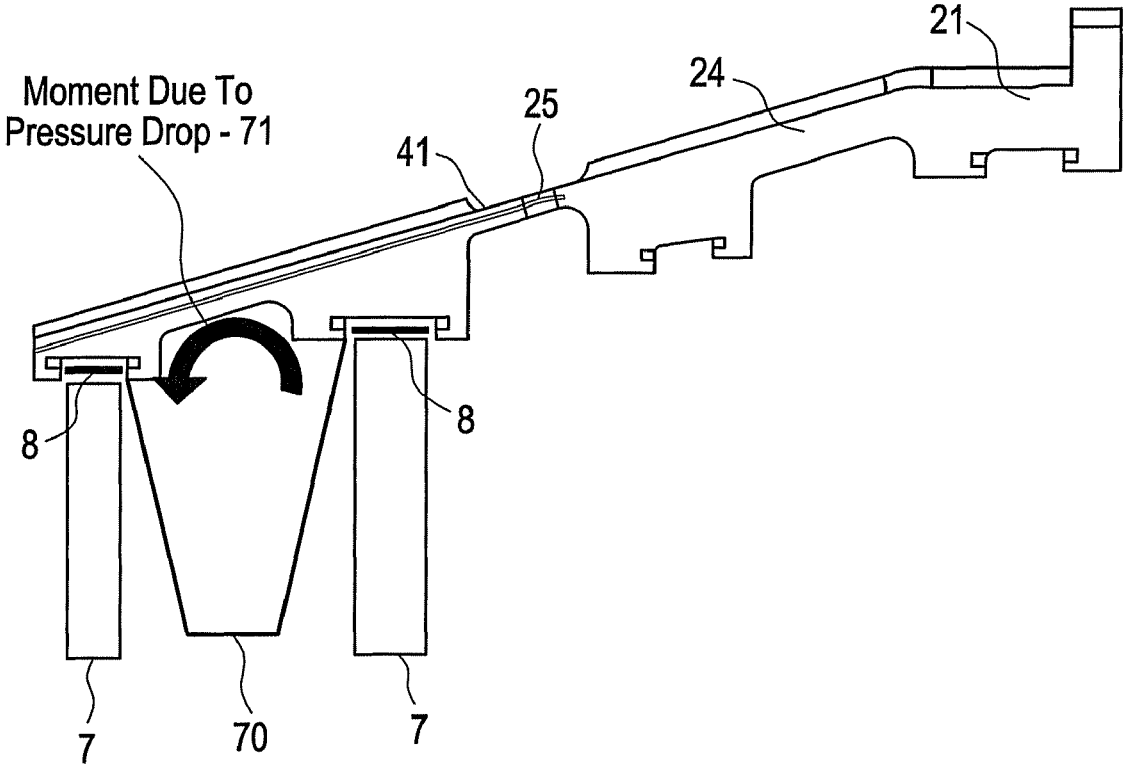
FIG. 7 illustrates an exemplary embodiment of the segment with a nozzle.

Another embodiment of the inner turbine shell 10 uses passive actuation to move the segments 24. With passive actuation, a relative pressure drop across components internal to the inner turbine shell 10 provides a force for moving the segments 24. One example of a component causing a pressure drop is a nozzle 70 illustrated in FIG. 7. Referring to FIG. 7, the nozzle 70 is attached to the inner turbine shell 10. The nozzle 70 is disposed between two turbine stages 7. The nozzle 70 redirects gas flow from one turbine stage 7 before the gas flow impinges the next turbine stage 7. There is a pressure drop across the nozzle 70 proportional to the mass flow rate of the gas turbine 1. During operation of the gas turbine 1, the mass flow rate varies with the speed and output of the gas turbine 1. The maximum pressure drop occurs at full speed and full load. In this embodiment, the maximum pressure drop across the nozzle 70 imparts a maximum bending moment 71 on each segment 24 as shown in FIG. 7. The maximum bending moment 71 will cause the segment 24 to move or bend inwardly reducing the diameter of the shroud ring 8. The stiffness of each segment 24 and a reduction of the pressure drop are used move the segments 24 outwardly increasing the diameter of the shroud ring 8. The actuator 50 may not be required with passive actuation. In other embodiments, a combination of passive and active actuation may be used.

A control system known to those skilled in the art of controls may be used to actuate the actuator 50. The control system may receive information related to the clearance 20 to control the actuator 50. The information may be provided by a sensor and used in a feedback control loop (referred to herein as "sensor based feedback control"). The sensor may measure at least one of the clearance 20 and parameters related to the clearance 20. The feedback control loop will control the variable measured by the sensor to maintain a setpoint. Alternatively, the information may be derived from a model of the gas turbine 1 (referred to herein as "model based control"). Generally a detailed analysis and testing are used to provide the information related to determining an amount of the clearance 20 required for different modes of operation. With model based control, sensors are not used to measure the clearance 20 as part of a feedback control loop.

Figure 8:
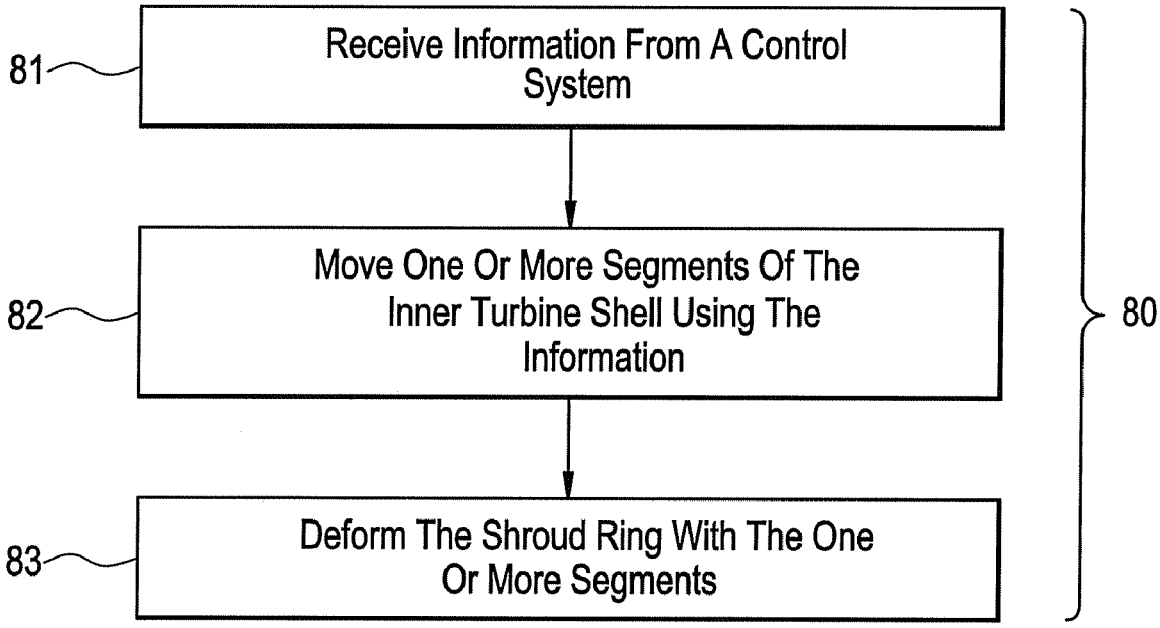
FIG. 8 presents an exemplary method for controlling a dimension of the shroud ring.

FIG. 8 presents an exemplary method 80 for controlling a dimension of the shroud ring 8. The clearance 20 may be controlled by controlling the dimension, such as a diameter, of the shroud ring 8. The method 80 calls for receiving 81 information from a control system. Further, the method 80 calls for moving 82 one or more of the segments 24 of the inner turbine shell 10 using the information. Further, the method 80 calls for deforming 83 the shroud ring 8 with the one or more of the segments 24.

The method 80 may be implemented by a computer program product included in the control system. The computer program product is generally stored on machine-readable media and includes machine executable instructions for controlling a dimension of the shroud ring 8 in the gas turbine 1. The technical effect of the computer program product is to increase the efficiency of and prevent damage to the gas turbine 1 by controlling the clearance 20.

The use of an assembly of the sections 21 provides advantages in maintenance of the gas turbine 1. Service and maintenance of the gas turbine 1 may include disassembling the hoop 22 and rotating the inner turbine shell 10 about the longitudinal axis 11 to gain access to any section 21. When the top half of the casing 9 is removed, a selected section 21 may be removed and replaced individually without removing the shaft 5. Further, service and maintenance may include removing and replacing the entire inner turbine shell 10 without removing the shaft 5 by removing and replacing the sections 21 individually. Along with removing the inner turbine shell 10, nozzles, such as the nozzle 70, and the shroud ring 8 may also be removed. By not removing the shaft 5, realigning the shaft 5 and associated bearings and bearing housings can be eliminated.

Gas turbines 1 are often built to be disassembled using a bolted flange at the horizontal midplane. The inclusion of the flange along with circular discontinuity associated with the flange may cause the casing 9 to become out-of-round during engine operation due to thermal gradients. In terms of Fourier coefficients, the casing 9 with two halves is termed to have N=2 out-of-roundness. By dividing the inner turbine shell 10 into the sections 21 and assembling the sections 21 by at least one hoop 22, circularity is improved over the use of flanges. For the same thermal gradient, the out-of-roundness of the inner turbine shell 10 is decreased as the number of sections 21 used to build the inner turbine shell 10 is increased. For example, the inner turbine shell 10 with four sections 21 (N=4) has less out-of-roundness then the inner turbine shell 10 with two sections 21 (N=2). Numerous sections 21 held together with at least one hoop 22 provides a way of reducing out-of-roundness of the inner turbine shell 10.

Various components may be included and called upon for providing for aspects of the teachings herein. For example, the control system may include at least one of an analog system and a digital system. The digital system may include at least one of a processor, memory, storage, input/output interface, input/output devices, and a communication interface. In general, the computer program product stored on machine-readable media can be input to the digital system. The computer program product includes instructions that can be executed by the processor for controlling the clearance 20. The various components may be included in support of the various aspects discussed herein or in support of other functions beyond this disclosure.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An inner shell for a rotating machine comprising:

at least one segment; and at least one complementary segment in operable communication with the at least one segment, the segments forming a support structure for a shroud ring;

wherein the at least one segment and the at least one complementary segment are individually moved to change a set of dimensions defined by the at least one segment and the at least one complementary segment, and the inner shell includes a plurality of slots extending partway along a length of the inner shell to form the at least one segment and the at least one complementary segment.

2. The shell as in claim 1, wherein the at least one segment and the at least one complementary segment are collectively moved to change a set of dimensions defined by the at least one segment and the at least one complementary segment.

3. The shell as in claim 1, further comprising a seal disposed between the at least one segment and the at least one complementary segment.

4. The shell as in claim 1, wherein the seal comprises a flat member shaped to match a sealing slot in the at least one segment and the at least one complementary segment, the flat member coupled to a folded sealing structure.

5. The shell as in claim 1, further comprising an actuator in operable communication with the at least one segment.

6. The shell as in claim 5, wherein the actuator is at least one of a mechanical actuator, an electrical actuator, and an electro-mechanical actuator.

7. The shell as in claim 1, further comprising a sleeve in operable communication with an actuator and the segments.

8. The shell as in claim 1, further comprising sections wherein each section comprises at least one of the segment and the complementary segment.

9. The shell as in claim 8, wherein the sections are radially restrained by a perimetrically coupled structure.

10. The shell as in claim 9, wherein the perimetrically coupled structure comprises at least one hoop.

11. The shell as in claim 1, wherein each of the at least one segment and the at least one complimentary segment comprise a flat beam extending in a width direction of the at least one segment and the at least one complementary segment, the flat beam having a thickness less than a thickness of curved portions of the at least one segment and the at least one complementary segment.

12. A rotating machine comprising:

a housing;

a rotating component disposed at the housing;

a shroud ring disposed adjacent to the rotating component;

a shell comprising segments, at least one segment in operable communication with the shroud ring, wherein at least one dimension of the shroud ring is adjustable by the shell to radially bend the at least one segment in operable communication with the shroud ring.

13. The rotating machine as in claim 12, wherein the shell comprises sections.

14. The rotating machine as in claim 13, wherein the sections are radially constrained by a perimetrically coupled structure.

15. The rotating machine as in claim 12, further comprising a seal disposed between two adjacent segments.

16. The rotating machine as in claim 12, further comprising an actuator in operable communication with at least one segment of the segmented shell.

17. The rotating machine as in claim 16, wherein the actuator comprises gas pressure acting upon the segments.

18. The rotating machine as in claim 12, further comprising a sleeve in operable communication with an actuator and the segments.

19. The rotating machine as in claim 12, further comprising passive actuation of the segments wherein the passive actuation comprises a change in pressure within the shell.

20. The rotating machine as in claim 12, further comprising a control system for operating an actuator in operable communication with the segments.

21. The rotating machine as in claim 20, wherein the control system comprises at least one of sensor based feedback control and model based control.

22. A method for controlling a dimension of a shroud ring in a rotating machine, the method comprising:

receiving information from a control system;

radially bending one or more segments of a shell using the information, the shell in operable communication with the shroud ring; and deforming the shroud ring with the one or more of the segments.

23. The method as in claim 22, wherein the method is implemented by a computer program product stored on machine-readable media and comprising machine executable instructions for controlling a dimension of a shroud ring in a rotating machine, the product comprising instructions for:

receiving information from the control system;

radially bending the one or more segments of the shell using the information; and deforming the shroud ring with the one or more of the segments.

* * * * *